US005658620A

United States Patent [19]

Ross

[11] Patent Number: 5,658,620

[45] Date of Patent: Aug. 19, 1997

[54] PLACE MAT HAVING ERECTABLE AND INTERCHANGEABLE POP-UP FIGURES

[75] Inventor: Norman C. Ross, Calabasas, Calif.

[73] Assignee: Trust One N. Joseph and Jeanette Ross, Beverly Hills, Calif.; Living Trust dated May 3, 1985

[21] Appl. No.: 444,540

[22] Filed: May 19, 1995

[51] Int. Cl.[6] ..... G09F 1/00

[52] U.S. Cl. ..... 428/9; 40/539; 428/12

[58] Field of Search ..... 428/12, 7, 9; 40/539, 40/124.1, 124.08; 446/148

[56] References Cited

U.S. PATENT DOCUMENTS

| | | | |
|---|---|---|---|
| 565,450 | 8/1896 | Gibson | 40/539 X |
| 890,135 | 6/1908 | Gilliland | 40/539 X |
| 1,854,225 | 4/1932 | Rosenthal | 40/539 |
| 1,870,395 | 8/1932 | Zarin | 40/539 |
| 2,074,420 | 3/1937 | Otis | 40/539 |
| 2,078,022 | 4/1937 | Roemer | 446/227 |
| 2,148,279 | 2/1939 | Sandberg | 40/539 |
| 2,892,278 | 6/1959 | Hoeflich | 40/539 X |
| 3,191,328 | 6/1965 | Lohnes | 428/12 X |
| 3,235,988 | 2/1966 | Paige | 428/12 X |
| 3,440,747 | 4/1969 | Oliver | 40/539 |
| 5,096,752 | 3/1992 | Wagner | 428/13 |
| 5,256,457 | 10/1993 | Pantaleo et al. | 428/13 |

*Primary Examiner*—Henry F. Epstein

*Attorney, Agent, or Firm*—Thomas I. Rozsa; Tony D. Chen

[57] ABSTRACT

Decorative pop-up figures are removably attached to a place mat for persons to entertain them and to provide amusement. The place mat comprises two horizontal sheets which form a horizontal base for the place mat. There is a slot or multiplicity of slots in the top sheet. The pop-up figures have horizontal members which in turn fit into the slot openings and can be attached in place such that when the place mat is folded, the pop-up figures are concealed and stored within the place mat. Then when the place mat is ready for use, the place mat is unfolded such that the pop-up figures erect relative to the horizontal base to provide the decorative artwork design characters for display.

18 Claims, 2 Drawing Sheets

PLACE MAT HAVING ERECTABLE AND INTERCHANGEABLE POP-UP FIGURES

BACKGROUND OF THE INVENTION

1. Field of the Invention

The present invention generally relates to the field of place mats. More particularly, the present invention relates to the field of place mats having pop-up figures which act as toys for entertaining children or adults.

2. Description of the Prior Art

Various of devices to assist parents in the process of feeding their children during mealtime are known in the prior art. Generally, such devices are utilized to enhance the interest or retain the attention of children or adults (hereafter referred as "persons") while they were eating.

The following twelve (12) prior art patents were uncovered in the pertinent field of the present invention:

1. U.S. Pat. No. 565,450 issued to Gibson on Aug. 11, 1896 for "Toy" (hereafter "the Gibson Patent");
2. U.S. Pat. No. 890,135 issued to Gilliland on Jun. 9, 1908 for "Card" (hereafter "the Gilliland Patent");
3. U.S. Pat. No. 1,854,225 issued to Rosenthal on Apr. 19, 1932 for "Advertising Device" (hereafter "the Rosenthal Patent");
4. U.S. Pat. No. 1,870,395 issued to Zarin on Aug. 9, 1932 for "Advertising Novelty" (hereafter "the Zarin Patent");
5. U.S. Pat. No. 2,074,420 issued to Otis on Mar. 23, 1937 for "Display Device" (hereafter "the Otis Patent");
6. U.S. Pat. No. 2,078,022 issued to Roemer on Apr. 20, 1937 for "Infant's Play Pad" (hereafter "the Roemer Patent");
7. U.S. Pat. No. 2,148,279 issued to Sandberg on Feb. 21, 1939 for "Folding Postcard Or Window Display" (hereafter "the Sandberg Patent");
8. U.S. Pat. No. 3,191,328 issued to Lohnes on Jun. 29, 1965 for "Animated Greeting Card" (hereafter "the Lohnes Patent");
9. U.S. Pat. No. 3,235,988 issued to Paige on Feb. 22, 1966 for "Greeting Card" (hereafter "the Paige Patent");
10. U.S. Pat. No. 3,440,747 issued to Oliver on Apr. 29, 1969 for "Display Means For Cartons, Folders And The Like" (hereafter "the Oliver Patent");
11. U.S. Pat. No. 5,096,752 issued to Wagner on Mar. 17, 1992 for "Placemat With Changeable Card Display" (hereafter "the Wagner Patent"); and
12. U.S. Pat. No. 5,256,457 issued to Pantaleo et al. on Oct. 26, 1993 for "Serving Mat With Floating Figurines That Are Alignable With Graphics In The Base Of The Serving Mat" (hereafter "the Pantaleo Patent").

The Gibson Patent discloses a toy which shows various pop-up figures on a card surface.

The Gilliland Patent discloses a card. It comprises a character which has a base, a flap mounted upon the base and formed near its foot portion with laterally extending tabs. An elastic band is secured to the base and engaged with the tabs so as to exert tension to hold the character in angular relation to the flap and to the base, thereby maintaining the flap in an erect position on the base.

The Rosenthal Patent discloses an advertising device with pop-up figures on a flat display.

The Zarin Patent discloses an advertising novelty which also shows pop-up figures on a horizontal display.

The Otis Patent discloses a display device with pop-up figures on a flat surface.

The Roemer Patent discloses an infant's play pad. It comprises a fabric base which has a decorated border. An absorbent pad is removably attached to the central portion of the base. Swivelled rings are attached to the pad and members are longitudinally slidable in the rings, with toys that are attached thereon.

The Lohnes Patent discloses an animated greeting card with a pop-up figure on the card.

The Sandberg Patent discloses a folding postcard which has a window display and pop-up figures that sit on the postcard.

The Paige Patent discloses a greeting card which is a pop-up card. It is designed such that when the pages of the greeting card are opened, an accessory panel is raised between the pages to a position thereabove, and when the pages of the card are closed the accessory panel lies between the pages of the card.

The Oliver Patent discloses display means cartoons which sit on top of a horizontal surface and can pop up on the surface.

The Wagner Patent discloses a place mat with a changeable card display. It comprises a mat which has a plurality of cutouts to accommodate baseball cards or cards depicting other athletes.

The Pantaleo Patent discloses a serving mat with floating figurines that are alignable with graphics in the base of the serving mat. It comprises a pair of superimposed pliable sheets that are sealed along peripheral edges. The mat comprises an enclosed, liquid-containing inner chamber defined by the sealed peripheral edges and by the pair of superimposed pliable sheets. The liquid is freely movable within the chamber.

None of the prior art patents have disclosed pop-up configurations which are specifically used for place mats. Therefore, there is a need to have a very efficient and also very effective design and construction of a place mat which is ready for use, when the place mat is opened up; and further comprises pop-up figures that will pop up to provide decorative artwork design characters to amuse persons. It is desirable to have a specific way in which the pop-up figures are erected into position when the place mat is unfolded in the opened condition.

SUMMARY OF THE INVENTION

The present invention apparatus comprises a multiplicity of decorative pop-up figures which are secured on a place mat for persons to entertain them and to provide amusement for them when they are eating or engaged in other activities.

The place mat has a base which is formed by two horizontal sheets. The horizontal sheets are attached together at their edges and form an interior space between the sheets. There is a slot opening or multiplicity of slot openings in the top sheet. The pop-up figures themselves contain horizontal members which in turn fit into the slot openings and can be glued in place.

When the place mat is in the folded condition, the pop-up figures are stored and concealed within the place mat. When the place mat is ready for use, the place mat can be unfolded to the open condition and the pop-up figures will be erected relative to the horizontal base surface to provide the decorative artwork design characters to amuse the persons.

It is therefore an object of the present invention to provide an apparatus with decorative pop-up figures to pop up and form a display on a place mat for persons to help entertain them and to provide amusement.

It is also an object of the present invention to provide an apparatus with decorative pop-up figures which are interchangeable so that different arrangements can be created and displayed on a place mat.

It is an additional object of the present invention to provide an apparatus with decorative pop-up figures to pop up and form the display on a place mat, in which the entire apparatus is disposable.

It is a further object of the present invention to provide an apparatus with decorative pop-up figures to pop up and form the display on a place mat, in which the entire apparatus is laminated for long usage.

It is still an object of the present invention to provide an apparatus with decorative pop-up figures which can withstand the forces or food and other items placed on a place mat and being jostled by the person.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within .the spirit, scope and contemplation of the present invention as further defined in the appended claims.

Figure 1:
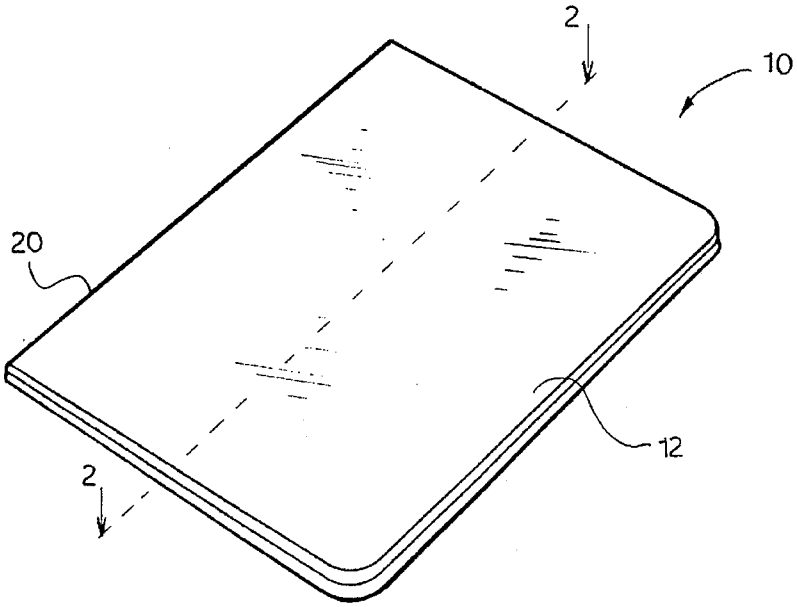
FIG. 1 is a perspective view of the present invention place mat in its folded condition.
Figure 2:
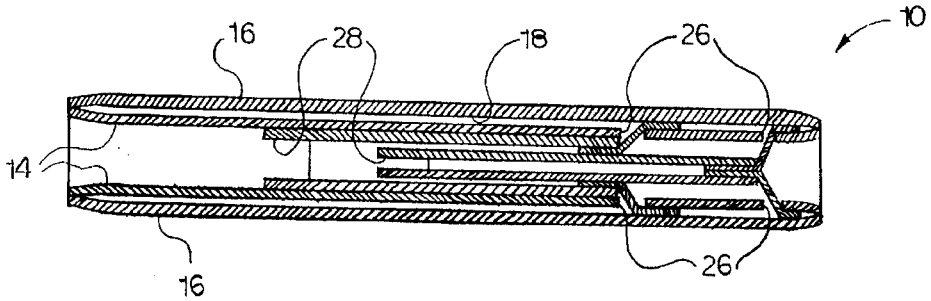
FIG. 2 is a cross-sectional view taken along line 2—2 of FIG. 1.
Figure 3:
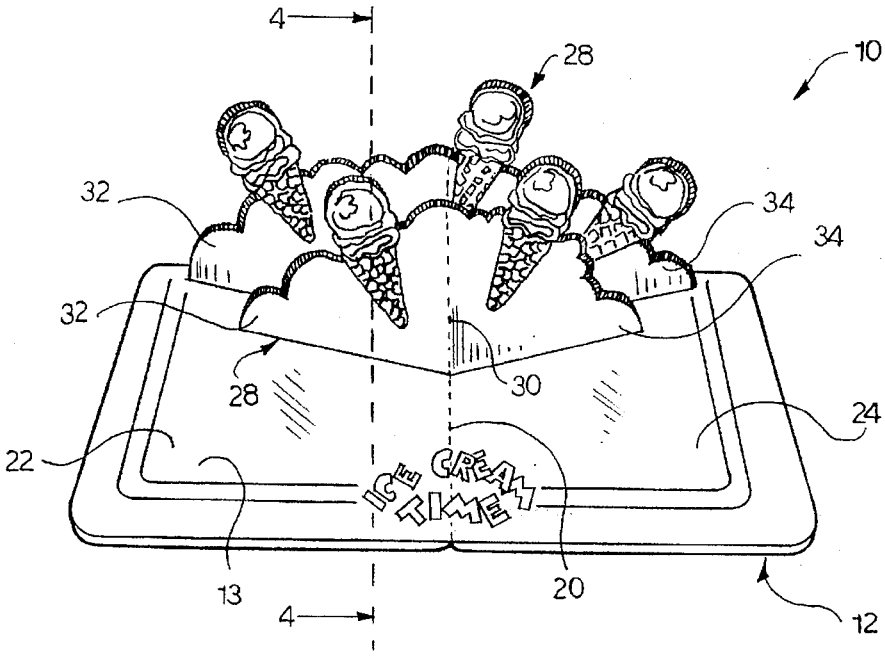
FIG. 3 is a perspective view of the present invention place mat in its unfolded condition, illustrating pop-up figures in the erected position to form the display on the place mat.

FIG. 1 shows the present invention apparatus 10 in its folded condition, while FIG. 3 shows the present invention apparatus 10 in its unfolded condition. Referring to FIGS. 1, 2 and 3, there is shown at 10 the present invention apparatus which comprises a place mat 12. The place mat 12 is formed by a pair of horizontal sheets 14 and 16 which are attached at their edges by glue or any other conventional means known to one skilled in the art and form a horizontal base surface 13 for the place mat 12.

Figure 4:
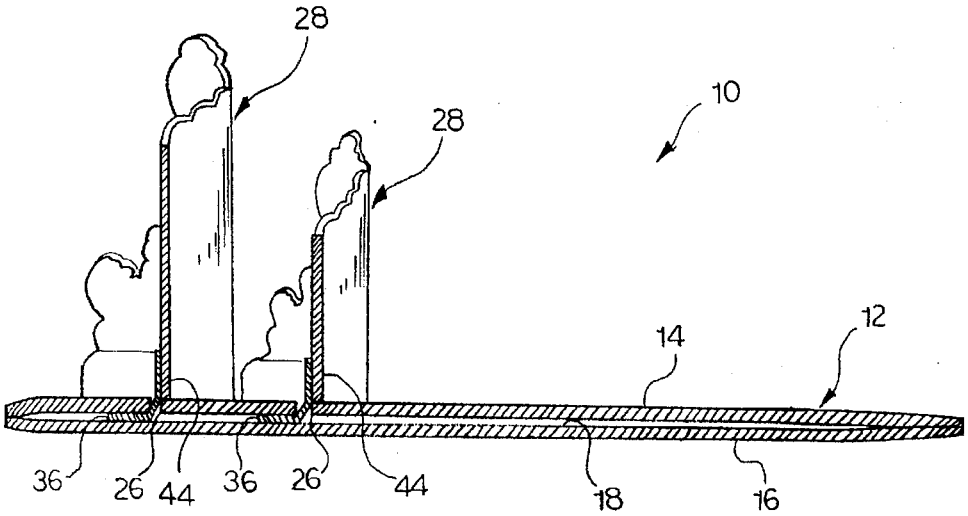
FIG. 4 is a cross-sectional view taken along line 4—4 of FIG. 3.

Referring to FIGS. 3 and 4, the place mat 12 has a central fold joint 20 which is foldable to form two opposite sides 22 and 24, each side being substantially the same shape and size. The top horizontal sheet 14 has a multiplicity of slot openings 26 which are located symmetrically on the two sides 22 and 24 of the place mat 12 and between the central fold joint 20.

A multiplicity of decorative pop-up figures 28 are utilized with the place mat 12. By way of example only, the multiplicity of pop-up figures 28 shown in FIG. 3 illustrate cartoon characters thereon. It will be appreciated that the cartoon characters illustrated in FIG. 3 are merely one illustrative embodiment and the pop-up figures 28 can include many other illustrations. For example, the multiplicity of pop-up figures 28 can have depictions of sports heroes in baseball, football, basketball, or hockey or any other illustration that would entertain persons to provide amusement for them. Each of the multiplicity of pop-up figures 28 also has a fold joint 30 which is foldable to form two opposite sides 32 and 34 of the pop-up figures 28. The pop-up figures 28 themselves contain movable or attachment horizontal members 36 which in turn fit into the slot openings 26 respectively and can be glued in place or fixed in place by any other suitable means or just simply inserted in the slot openings so that the pop-up figures 28 can be interchangeable with other pop-up figures which have different depictions.

Figure 5:
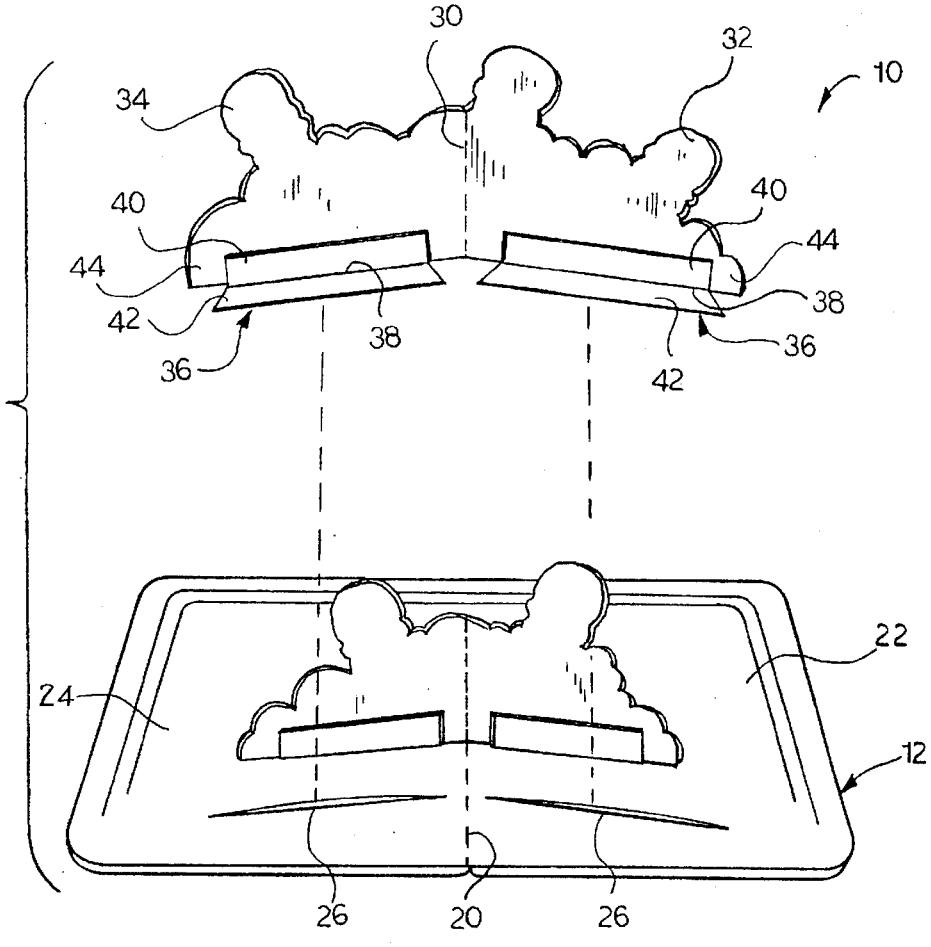
FIG. 5 is a rear perspective view of the present invention place mat with one of the pop-up figures attached to the place mat and the other one of the pop-up figures detached from the place mat.

Referring to FIGS. 4 and 5, there is shown the movable horizontal member 36 which has a horizontal fold joint 38 foldable to form a top edge 40 and a bottom edge 42. The top edge 40 of the movable member 36 is respectively attached to a bottom edge 44 of each one of the two sides 32 and 34 of the multiplicity of decorative pop-up figures 28. Each bottom edge 42 of the movable member 36 is respectively inserted and secured to a respective one of the multiplicity of slot openings 26 on the plate mat 12. One of the features of the present invention apparatus 10 is that when the two horizontal sheets 14 and 16 are attached together, they form an interior space 18 therebetween so that the bottom edges 42 of the movable members 36 can be secured between the top and bottom sheets 14 and 16. The slight compression between the top and bottom sheets 14 and 16 is enough to maintain the movable members 36 in place without using glue or other means to keep the movable members 36 in place.

When the apparatus 10 is in its folded condition (see FIG. 1), the place mat 12 is folded in half and will cause the multiplicity of decorative pop-up figures 28 to be folded at their fold joints 30 so that the pop-up figures 28 are concealed, stored and protected between the two opposite sides 22 and 24 of the place mat 12. The movable members 36 will be forced to a flat level surface (180°) which in turn pushes the sides 32 and 34 of the pop-up figures 28 downward so that the place mat 12 can be folded. When the apparatus 10 is ready for use, the place mat 12 is unfolded to the open condition (see FIG. 3) and the multiplicity of pop-up figures 28 are erected into position relative to the horizontal base surface 13 of the place mat 12 to provide decorative artwork design characters to amuse persons. The movable members 36 will be forced to an angle of 90° which in turn pulls the sides 32 and 34 of the pop-up figures 28 into the erect position.

Although this is one method by which the pop-up figures 28 can be attached to the place mat 12, there can be other alternative attachment methods which are also within the spirit and scope of the present invention.

While the present invention has been demonstrated with a multiplicity of pop-up figures 28, it will be appreciated that the present invention can be utilized with at least one pop-up figure. In addition, while the present invention has been illustrated with a multiplicity of attachment horizontal members 36, it will be appreciated that the present invention will also work with at least one attachment member 36 attached to at least one side of the pop-up member and attached to at least one slot within the place mat.

The present invention conforms to conventional forms of manufacture, and is of simple construction and is easy to use. The present invention apparatus 10 can be made from several materials. By way of example, the most cost effective material is rigid paper or stiff cardboard, which can be disposable after use. The place mat 12 can be made of disposable rigid paper while the pop-up figures 28 can be made of any other suitable material which can be laminated for long usage and can be used with other place mats. The place mats 12 can also be made of plastic, vinyl or other reusable material.

Defined in detail, the present invention is an apparatus for entertaining persons, comprising: (a) a place mat having a pair of horizontal sheets attached at their edges and a central fold joint foldable to form two opposite sides of the place mat, the two opposite sides being substantially the same shape and size; (b) a respective one of said pair of horizontal sheets having a multiplicity of slot openings and located on each one of said two sides of said place mat; (c) a multiplicity of decorative pop-up figures each having a central fold joint foldable to form two opposite sides; and (d) two movable members each having a horizontal fold joint foldable to form a bottom edge and a top edge, where the top edge of each respective movable member is respectively attached to a bottom edge of a respective one of said two sides of said multiplicity of decorative pop-up figures, the bottom edge of each movable member respectively inserted into a respective one of said multiplicity of slot openings and thereby secured between said pair of horizontal sheets, where folding said pair of horizontal sheets of said place mat at said central fold joint will cause said multiplicity of decorative pop-up figures to be folded at their fold joints for storage, and unfolding said pair of horizontal sheets of said place mat at said central fold joint will erect said multiplicity of decorative pop-up figures for display; (e) whereby when said place mat is in its folded condition, said multiplicity of pop-up figures are concealed and stored between said two opposite sides of said place mat, and when said place mat is ready for use, said place mat can be unfolded and said pop-up figures are erected into position to provide amusement to the persons and keep them happy.

Defined broadly, the present invention is an apparatus for entertaining persons, comprising: (a) a place mat having at least one sheet and a fold joint foldable to form two sides of the place mat, the two sides each having a slot opening; (b) at least one decorative pop-up figure having a fold joint foldable to form two sides; and (c) an attachment member having a fold joint foldable to form a bottom edge and a top edge respectively attached to a bottom edge of each one of said two sides of said at least one decorative pop-up figure, the bottom edge of the attachment member respectively inserted and secured to each one of said slot openings of said two sides of said at least one sheet, where folding said at least one sheet of said place mat at said fold joint will cause said at least one decorative pop-up figure to be folded at said fold joint for storage, and unfolding said at least one sheet of said place mat at said fold joint will erect said at least one decorative pop-up figure for display; (d) whereby when said place mat is in its folded condition, said at least one pop-up figure is concealed and stored between said two sides of said at least one sheet of said place mat, and when said place mat is ready for use, said place mat can be unfolded and said at least one pop-up figure erects into position to provide amuse to the persons and keep them happy.

Defined more broadly, the presents invention is an apparatus for entertaining persons, comprising: (a) a place mat having a pair of horizontal sheets attached at their edges and a central fold joint foldable to form two opposite sides of the place mat; (b) at least one of said pair of horizontal sheets having at least one slot opening which extends into the space between the two horizontal sheets; (c) at least one decorative pop-up figure having a central fold joint foldable to form two opposite sides; and (d) at least one attachment member having a fold joint foldable to form a bottom edge and a top edge which is attached to a bottom edge of at least one side of said at least one decorative pop-up figure, the bottom edge of the attachment member inserted into the at least one slot opening and thereby secured between said pair of horizontal sheets, where folding said pair of horizontal sheets of said place mat at said central fold joint will cause said at least one decorative pop-up figure to be folded at its fold joint for storage, and unfolding said pair of horizontal sheets of said place mat at said central fold joint will erect said at least one decorative pop-up figure for display.

Defined even more broadly, the present invention is an apparatus for entertaining persons, comprising: (a) a place mat having at least one sheet with a fold joint foldable to form two sides of the place mat, at least one of the two sides having a slot Opening; (b) at least one pop-up figure having a fold joint foldable to form two sides; (c) means for erecting said at least one pop-up figure such that unfolding said at least one sheet of said place mat at said fold joint will erect said at least one pop-up figure, and folding said at least one sheet of said place mat at said fold joint will cause said at least one pop-up figure to be folded at said fold joint; and (d) the place mat is operated such that when said place mat is in its folded condition, said at least one pop-up figure is concealed and stored between said two sides of said at least one sheet of said place mat, and when said place mat is ready for use, said place mat can be unfolded and said at least one pop-up figure erects into position to provide amusement to the persons and keep them happy.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A place mat for entertaining persons, comprising:

a. a pair of horizontal sheets attached at their edges, each sheet having a central fold joint foldable to form two opposite sides, the two opposite sides being substantially the same shape and size;

b. a respective one of said pair of horizontal sheets having a multiplicity of slot openings located on each one of said two sides;

c. a multiplicity of decorative pop-up figures, each having a central fold joint foldable to form two opposite sides; and d. two movable members each having a horizontal fold joint foldable to form a bottom edge and a top edge, where the top edge of each respective movable member is respectively attached to a bottom edge of a respective one of said two sides of said multiplicity of decorative pop-up figures, the bottom edge of each movable member is respectively inserted into a respective one of said multiplicity of slot openings and thereby retained between said pair of horizontal sheets, where folding each of said two opposite sides of said pair of horizontal sheets together at said central fold joint will cause the top edge of each movable member to move into a horizontal position parallel to said pair of horizontal sheets which in turn cause said multiplicity of decorative pop-up figures to be folded at their fold joints for storage, and unfolding each of said two opposite sides of said pair of horizontal sheets apart at said central fold joint will cause the top edge of each movable member to move into a vertical position perpendicular to said pair of horizontal sheets which in turn cause said multiplicity of decorative pop-up figures to erect for display;

e. whereby when said place mat is in its folded condition, said multiplicity of pop-up figures are concealed and stored between said two opposite sides of said pair of horizontal sheets, and when said place mat is ready for use, said two opposite sides of said pair of horizontal sheets can be unfolded and said multiplicity of decorative pop-up figures are erected into position to provide amusement to the persons and keep them happy.

2. The place mat in accordance with claim 1 wherein said pair of horizontal sheets are made of rigid paper material.

3. The place mat in accordance with claim 1 wherein said pair of horizontal sheets are laminated for long usage.

4. The place mat in accordance with claim 1 wherein said multiplicity of decorative pop-up figures are made of rigid paper material.

5. The place mat in accordance with claim 1 wherein said multiplicity of decorative pop-up figures are laminated for long usage and are interchangeable with other pop-up figures to form a different arrangement for display on said place mat.

6. The place mat in accordance with claim 1 wherein said multiplicity of decorative pop-up figure can have multiplicity of depictions.

7. A place mat for entertaining persons, comprising:

a. a pair of horizontal sheets attached at their edges to form a space therebetween, each sheet having a central fold joint foldable to form two opposite sides;

b. at least one of said pair of horizontal sheets having at least one slot opening which extends into said space;

c. at least one decorative pop-up figure having a central fold joint foldable to form two opposite sides; and d. at least one attachment member having a fold joint foldable to form a bottom edge and a top edge which is attached to a bottom edge of at least one side of said at least one decorative pop-up figure, the bottom edge of the attachment member inserted into the at least one slot opening and thereby retained between said pair of horizontal sheets, where folding each of said two opposite sides of said pair of horizontal sheets at said central fold joint will cause the top edge of the at least one attachment member to move into a horizontal position parallel to said pair of horizontal sheets which in turn causes said at least one decorative pop-up figure to be folded at its fold joint for storage, and unfolding each of said two opposite sides of said pair of horizontal sheets at said central fold joint will cause the top edge of the at least one attachment member to move into a vertical position perpendicular to said pair of horizontal sheets which in turn causes said at least one decorative pop-up figure to erect for display.

8. The place mat in accordance with claim 7 wherein said pair of horizontal sheets are made of cardboard material.

9. The place mat in accordance with claim 7 wherein said pair of horizontal sheets are laminated for long usage.

10. The place mat in accordance with claim 7 wherein said at least one decorative pop-up figure is made of cardboard material.

11. The place mat in accordance with claim 7 wherein said at least one decorative pop-up figure is laminated for long usage and being interchangeable with other pop-up figures to form a different display for displaying on said place mat.

12. The place mat in accordance with claim 7 wherein said at least one decorative pop-up figure can have multiplicity of depictions.

13. A place mat, comprising:

a. at least one sheet having a fold joint foldable to form two sides, at least one of the two sides having at least one slot opening;

b. at least one decorative pop-up figure having a fold joint foldable to form two sides; and c. an attachment member having a fold joint foldable to form a bottom edge and a top edge which is attached to a bottom edge of at least one side of said at least one decorative pop-up figure, the bottom edge of the attachment member inserted into said at least one slot opening, and retained to the at least one sheet, where folding said two sides of said at least one sheet at said fold joint will cause the top edge of the attachment member to move which in turn causes said at least one decorative pop-up figure to be folded at said fold joint for storage, and unfolding said two sides of said at least one sheet at said fold joint will cause the top edge of the attachment member to move which in turn causes said at least one decorative pop-up figure to erect for display.

14. The place mat in accordance with claim 13 wherein said at least one sheet is made of cardboard material.

15. The place mat in accordance with claim 13 wherein said at least one sheet is laminated for long usage.

16. The place mat in accordance with claim 13 wherein said at least one decorative pop-up figure is made of cardboard material.

17. The place mat in accordance with claim 13 wherein said at least one decorative pop-up figure is laminated for long usage and being interchangeable with other pop-up figures to form a different display for displaying on said place mat.

18. The place mat in accordance with claim 13 wherein said at least one decorative pop-up figure can have multiplicity of depictions.

* * * * *